US011779939B2

(12) United States Patent
Wang et al.

(10) Patent No.: US 11,779,939 B2
(45) Date of Patent: Oct. 10, 2023

(54) SELF-CLEANING DEVICE AND A WATER OUTLET DEVICE

(71) Applicant: Xiamen Lota International Co., Ltd., Fujian (CN)

(72) Inventors: Xuedong Wang, Fujian (CN); Jiangcheng Zhang, Fujian (CN); Zhixin Lin, Fujian (CN); Chuanbao Zhu, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 226 days.

(21) Appl. No.: 17/217,617

(22) Filed: Mar. 30, 2021

(65) Prior Publication Data

US 2021/0308697 A1 Oct. 7, 2021

(30) Foreign Application Priority Data

Apr. 3, 2020 (CN) ..... 202010260788.5

(51) Int. Cl.

| | |
|---|---|
| ***B05B 1/18*** | (2006.01) |
| ***B05B 15/528*** | (2018.01) |
| ***B05B 15/522*** | (2018.01) |

(52) U.S. Cl.
CPC ..... *B05B 1/185* (2013.01); *B05B 15/522* (2018.02); *B05B 15/528* (2018.02)

(58) Field of Classification Search
CPC ..... B05B 1/18; B05B 1/185; B05B 1/3046; B05B 15/52; B05B 15/522; B05B 15/5223; B05B 15/5225; B05B 15/528
See application file for complete search history.

(56) References Cited

U.S. PATENT DOCUMENTS 5,228,625 A * 7/1993 Grassberger ..... B05B 15/528 239/602
2018/0099295 A1* 4/2018 Armbruster ..... B05B 1/185

FOREIGN PATENT DOCUMENTS

EP 2767347 A1 * 8/2014 ..... B05B 1/18

* cited by examiner

*Primary Examiner* — Darren W Gorman
(74) *Attorney, Agent, or Firm* — COOPER LEGAL GROUP, LLC

(57) ABSTRACT

A self-cleaning device and a water outlet device are provided. The self-cleaning device includes a liquid flow chamber, one or more ejector pins, and an elastic deformation body. The self-cleaning device is configured to remove scale in one or more liquid outlet holes of the self-cleaning device automatically.

14 Claims, 14 Drawing Sheets

SELF-CLEANING DEVICE AND A WATER OUTLET DEVICE

RELATED APPLICATIONS

This application claims priority to Chinese patent application number 202010260788.5, filed on Apr. 3, 2020. Chinese patent application number 202010260788.5 is incorporated herein by reference.

FIELD OF THE DISCLOSURE

The present disclosure relates to a self-cleaning device and a water outlet device.

BACKGROUND OF THE DISCLOSURE

At present, scale in a water stream easily adheres to water outlets of shower heads after a long time of use or when the shower heads are used in places with poor water quality. After a long period of time, the scale completely blocks the water outlets, causing the shower head to not function normally. In order to solve this problem, a user can use a sharp tool to descale the water outlets, and each water outlet needs to be treated separately during descaling. There is no guarantee that every water outlet can be cleaned thoroughly, and the sharp tool generally pushes the scale into the shower head. The scale therefore still remains inside the shower head, which may cause the water outlets to be blocked again. Furthermore, if the water outlets are made of a hard material, the scale in the water outlets cannot be removed by the sharp tool. When the scale blocks the water outlets completely, the user has to change shower heads, which increases the cost and reduces the service life of the shower head.

Chinese patent CN204276182U discloses a shower head with a function of removing scale. The shower head comprises a shower head body and a movable plate. The shower head body comprises a cooperation portion, and the movable plate comprises a guide pusher. The cooperation portion comprises an inclined plane. The movable plate moves up gradually along the inclined plane to push the guide pusher upwards, and the movable plate is pushed forward accordingly to a foremost position. At this time, a descaling structure on an upper surface of the movable plate passes through a first outlet hole of an outlet cover of the shower head. In this way, the scale in the outlet cover can be pushed out, and the effect of cleaning the scale in the shower head can be achieved. However, the descaling structure of shower head is complicated and occupies a large space in the shower head, which affects the size of the shower head. Moreover, after repeated use, the descaling structure is less stable and the lifespan is shortened.

BRIEF SUMMARY OF THE DISCLOSURE

The present disclosure provides a self-cleaning device to solve the deficiencies in the background.

In order to solve the technical problem, a first technical solution of the present disclosure is as follows.

A self-cleaning device comprises a liquid flow chamber, one or more ejector pins, and an elastic deformation body. The liquid flow chamber comprises an inlet and an outlet. The one or more ejector pins are arranged between the inlet and the outlet. The elastic deformation body is disposed on the outlet. The elastic deformation body comprises a deformation portion and a liquid outlet portion, the liquid outlet portion comprises one or more liquid outlet holes, and the one or more ejector pins extend toward the one or more liquid outlet holes. When a liquid flows in the liquid flow chamber, the deformation portion is deformed due to hydraulic pressure to form a liquid flow space between the one or more ejector pins and the one or more liquid outlet holes, and when there is no hydraulic pressure in the liquid flow chamber, the deformation portion is reset to an initial state, and the one or more ejector pins are inserted into the one or more liquid outlet holes to clean the one or more liquid outlet holes.

In a preferred embodiment, when the deformation portion is in the initial state: a bottom end surface of the one or more ejector pins is flush with an outer end surface of the one or more liquid outlet holes, and there is a clearance fit between the one or more ejector pins and the one or more liquid outlet holes, or the bottom end surface of the one or more ejector pins protrudes outside the outer end surface of the one or more liquid outlet holes, and there is a clearance fit between the one or more ejector pins and the one or more liquid outlet holes.

In a preferred embodiment, when the deformation portion is in the initial state, a bottom end surface of the one or more ejector pins moves into the one or more liquid outlet holes by at least half of a depth of the one or more liquid outlet holes, and there is a clearance fit between the one or more ejector pins and the one or more liquid outlet holes.

In a preferred embodiment, the elastic deformation body further comprises a fixed portion and a liquid outlet portion. The deformation portion connects the fixed portion and the liquid outlet portion. The fixed portion is fixed on an inner wall of the liquid flow chamber, and the liquid outlet portion is moveable into the outlet from an inner end of the outlet. The liquid outlet portion comprises the one or more liquid outlet holes. When the deformation portion is deformed, the deformation portion moves between the initial state and a deformation state at which the deformation portion abuts the inner end of the outlet.

In a preferred embodiment, a maximum width of the one or more ejector pins gradually decreases from the inlet to the outlet, and a maximum width of the one or more liquid outlet holes gradually decreases from the inlet to the outlet.

In a preferred embodiment, a width of the one or more ejector pins is constant, and a maximum width of the one or more liquid outlet holes gradually decreases from the inlet to the outlet.

In a preferred embodiment, a maximum width of the one or more ejector pins gradually decreases from the inlet to the outlet, and a width of the one or more liquid outlet holes is constant.

In a preferred embodiment, a maximum width of the one or more ejector pins gradually decreases from the inlet to the outlet, and a width of the one or more liquid outlet holes is constant.

In a preferred embodiment, a width of the one or more ejector pins is constant, and a width of the one or more liquid outlet holes is constant.

In a preferred embodiment, a wall of the liquid outlet portion comprises a stepped surface for increasing a hydraulic pressure area of the elastic deformation body.

In a preferred embodiment, the stepped surface is perpendicular to a center axis of the one or more liquid outlet holes.

In a preferred embodiment, a side edge of the stepped surface close to a center axis of the one or more liquid outlet holes is rounded.

In a preferred embodiment, the stepped surface is arranged obliquely with a center axis of the one or more liquid outlet holes to form an acute angle.

In a preferred embodiment, the one or more ejector pins is a plurality of ejector pins, the one or more liquid outlet holes is a plurality of liquid outlet holes, and the plurality of ejector pins and the plurality of liquid outlet holes are in a one-to-one correspondence.

In a preferred embodiment, a deformation space disposed between the elastic deformation body and the inner end of the outlet is provided for deformation of the deformation portion.

A second technical solution of the present disclosure is as follows.

A self-cleaning device comprises a liquid flow chamber, one or more ejector pins, and an elastic deformation body. The liquid flow chamber comprises an inlet and an outlet, and the one or more ejector pins are arranged between the inlet and the outlet. The elastic deformation body is disposed on the outlet, the elastic deformation body comprises a sheet-shaped deformation portion and one or more liquid outlet holes, and the one or more ejector pins extend toward the one or more liquid outlet holes. When a liquid flows in the liquid flow chamber, the sheet-shaped deformation portion is stretched and deformed to enable a thickness of the sheet-shaped deformation portion to stretch due to hydraulic pressure to form a liquid flow space between the one or more ejector pins and the one or more liquid outlet holes, and when there is no hydraulic pressure in the liquid flow chamber, the sheet-shaped deformation portion is reset to an initial state, and the one or more ejector pins are inserted into the one or more liquid outlet holes to clean the one or more liquid outlet holes.

In a preferred embodiment, the elastic deformation body further comprises a fixed portion and a liquid outlet portion, and the sheet-shaped deformation portion connects the fixed portion and the liquid outlet portion. The fixed portion is fixed on an inner wall of the liquid flow chamber, the liquid outlet portion is moveable into the outlet from an inner end of the outlet, and the liquid outlet portion comprises the one or more liquid outlet holes. When the sheet-shaped deformation portion is in the initial state: a top end surface of the sheet-shaped deformation portion is perpendicular with a center axis of the liquid outlet portion, or the top end surface of the sheet-shaped deformation portion is arranged obliquely with the center axis of the liquid outlet portion to form an acute angle. When the sheet-shaped deformation portion is deformed, the sheet-shaped deformation portion is stretched obliquely to enable the thickness of the sheet-shaped deformation portion to stretch.

In a preferred embodiment, a deformation space disposed between the elastic deformation body and an inner end of the outlet is provided for deformation of the sheet-shaped deformation portion.

In a preferred embodiment, an elongation rate of the sheet-shaped deformation portion is 1% to 20%.

In a preferred embodiment, an elongation rate of the sheet-shaped deformation portion is 3% to 6%.

A third technical solution of the present disclosure is as follows.

A water outlet device comprises the self-cleaning device.

Compared with the existing techniques, the technical solution has the following advantages.

1. The self-cleaning device realizes the function of conducting liquid or cleaning the one or more liquid outlet holes through the cooperation of the elastic deformation body and the hydraulic pressure. When the liquid stops flowing in the liquid flow chamber, the one or more ejector pins are inserted into the one or more liquid outlet holes to remove the scale in the one or more liquid outlet holes to achieve the purpose of descaling and cleaning. When the liquid flows in the liquid flow chamber, the deformation portion is deformed due to the hydraulic pressure to space apart the one or more ejector pins and the one or more liquid outlet holes to form a liquid flow space. At this time, the liquid can flow out of the liquid flow chamber through the liquid flow space. The self-cleaning device is not only simple in structure, but also requires a small space for the deformation process of the deformation portion of the elastic deformation body. Therefore, it is only necessary to reserve a small space in common water outlet devices such as shower heads or sprayers, and the size of the water outlet device does not change greatly to meet the pursuit of compactness. The self-cleaning device has a good cleaning and descaling effect. The one or more ejector pins can be inserted into the one or more liquid outlet holes, and one or more the liquid outlet holes are cleaned. The elastic deformation body has a long service life, is suitable for long-term repeated use, and avoids the trouble of frequent replacement.

2. When the deformation portion is in the initial state, the bottom end surface of the one or more ejector pins is flush with the outer end surface of the one or more liquid outlet holes or protrudes outside the outer surface end of the one or more liquid outlet holes. This arrangement can ensure that the scale in the entirety of the one or more liquid outlet holes can be ejected by the one or more ejector pins, and all the scale in the entire outlet hole can be pushed out, ensuring the cleaning effect and ensuring that there is no scale residue. When the deformation portion is in the initial state, there is a clearance fit between the one or more ejector pins and the one or more liquid outlet holes, which has the function of quickly stopping water.

3. The maximum width of the one or more ejector pins gradually decreases from the inlet to the outlet, and the maximum width of the one or more liquid outlet holes gradually decreases from the inlet to the outlet. When the deformation portion is deformed, the liquid flow space can be formed quickly, and when the deformation portion is reset to the initial state, the one or more ejector pins and the one or more liquid outlet holes can quickly contact each other, which can achieve the purpose of cleaning and achieve the effect of rapid water stop at the same time.

4. The one or more liquid outlet holes comprises a stepped surface for increasing the hydraulic pressure area of the elastic deformation body, so that the deformation portion is more quickly affected by the hydraulic pressure and the deformation sensitivity is higher.

5. The deformation portion has a sheet-shape, which makes it difficult to accumulate water in the liquid flow chamber while ensuring the cleaning of the one or more liquid outlet holes. At the same time, the thickness of the entire shower head can be designed to be thinner.

6. A deformation space formed between the elastic deformation body and the inner end of the outlet is provided for the deformation of the deformation portion, so as to ensure the smooth progress of the deformation of the deformation portion.

DETAILED DESCRIPTION OF THE EMBODIMENTS

Figure 1:
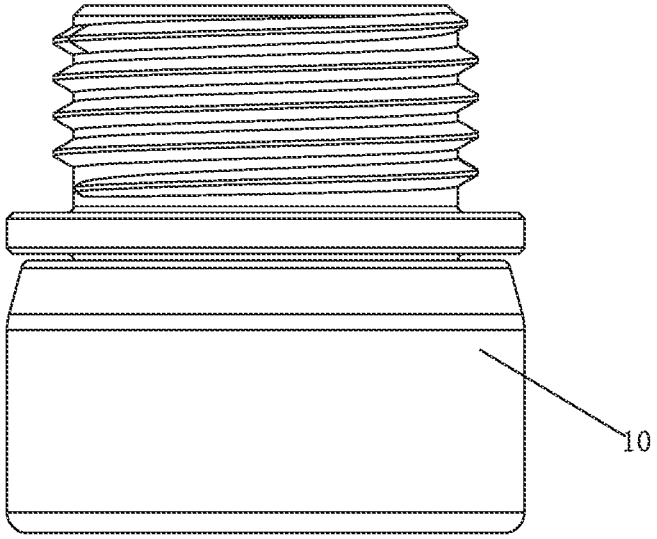
FIG. 1 illustrates a front view of a self-cleaning device according to a first embodiment.

The present disclosure will be further described below in combination with the accompanying drawings and embodiments.

Referring to FIGS. 1-4, a first embodiment of a self-cleaning device is provided. The self-cleaning device comprises a liquid flow chamber 10, one or more ejector pins 20, and an elastic deformation body 30. The liquid flow chamber 10 comprises an inlet 11 and an outlet 12. The one or more ejector pins 20 are arranged between the inlet 11 and the outlet 12 of the liquid flow chamber 10. The elastic deformation body 30 is disposed on the outlet 12.

Figure 2:
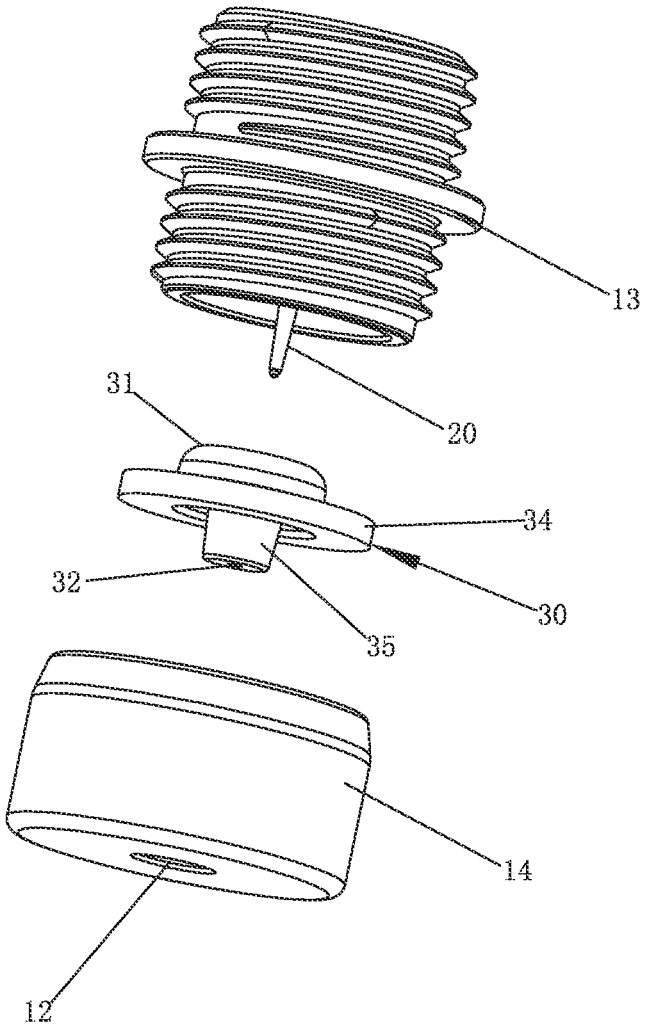
FIG. 2 illustrates an exploded perspective view of the self-cleaning device according to the first embodiment.

Referring to FIG. 2, the liquid flow chamber 10 comprises a first body 13 and a second body 14, which are screwed and fitted by threads to form the liquid flow chamber 10. The inlet 11 is disposed at a top of the first body 13, the outlet 12 is disposed at a bottom of the second body 14, and the one or more ejector pins 20 are integrally formed in the first body 13. In some embodiments, the one or more ejector pins 20 are not integrally formed in the first body 13 or the second body 14, and the one or more ejector pins 20 can be separated from the first body 13 or the second body 14. The liquid flow chamber 10 comprises one or more inlets 11 and one or more outlets 12, and each outlet 12 is provided with one ejector pin 20 of the one or more ejector pins 20. The elastic deformation body 30 comprises a deformation portion 31 and one or more liquid outlet holes 32, and the one or more ejector pins 20 extend toward the one or more liquid outlet holes 32. When a liquid flows in the liquid flow chamber 10, the deformation portion 31 is deformed due to hydraulic pressure to form a liquid flow space 33 (e.g. sufficient liquid flow space) between the one or more ejector pins 20 and the one or more liquid outlet holes 32. When there is no hydraulic pressure in the liquid flow chamber 10, the deformation portion 31 is reset to an initial state, and the one or more ejector pins 20 are inserted into the one or more liquid outlet holes 32 to clean the one or more liquid outlet holes 32.

Figure 3:
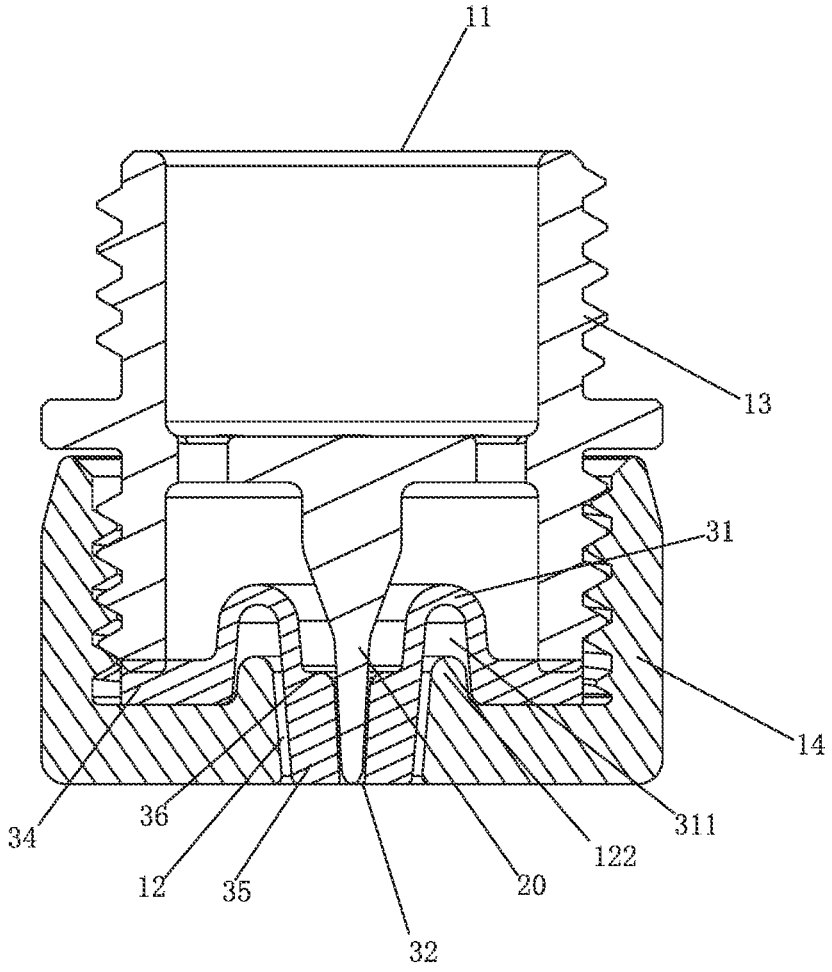
FIG. 3 illustrates a cross-sectional view of the self-cleaning device according to the first embodiment when a deformation portion is in an initial state and an ejector pin is inserted into an entirety of a liquid outlet hole.

In the first embodiment, referring to FIG. 3, when the deformation portion 31 is in the initial state, a bottom end surface of the one or more ejector pins 20 is flush with an outer end surface of the one or more liquid outlet holes 32 or protrudes outside the outer end surface of the one or more liquid outlet holes 32. There is a clearance fit between the one or more ejector pins 20 and the one or more liquid outlet holes 32, so when the deformation portion 31 is in the initial state, an entirety of the one or more liquid outlet holes 32 is in clearance fit with the one or more ejector pins 20, and the one or more ejector pins 20 can push out all the scale (e.g., dirt) in the one or more liquid outlet holes 32. In some embodiments, when the deformation portion 31 is in the initial state, the bottom end surface of the one or more ejector pin 20*s* moves into the one or more liquid outlet holes 32 by at least half of a depth of the one or more liquid outlet holes 32.

In the first embodiment, the elastic deformation body 30 further comprises a fixed portion 34 and a liquid outlet portion 35, and the deformation portion 31 connects the fixed portion 34 and the liquid outlet portion 35. The fixed portion 34 is clamped between the first body 13 and the second body 14 to be fixed in an inner wall of the liquid flow chamber 10, the liquid outlet portion 35 is movable into the outlet 12 from an inner end of the outlet 12, and the liquid outlet portion 35 comprises the one or more liquid outlet holes 32. When the deformation portion 31 is in a deformation state (e.g., a maximum deformation state), the deformation portion 31 abuts the inner end of the outlet 12, and when the deformation portion 31 is in the initial state, the deformation portion 31 is located away from (i.e., does not abut) the inner end of the outlet 12.

Referring to FIG. 3, the deformation portion 31 is in the initial state, in which the deformation portion 31 is not deformed, and is located away from the inner end of the outlet 12. In the first embodiment, a vertical section of the deformation portion 31 has an inverted U-shape when the deformation portion 31 is in the initial state. In some embodiments, the vertical section of the deformation portion 31 can also be V-shaped, trapezoidal, or triangular when the deformation portion 31 is in the initial state.

Figure 4:
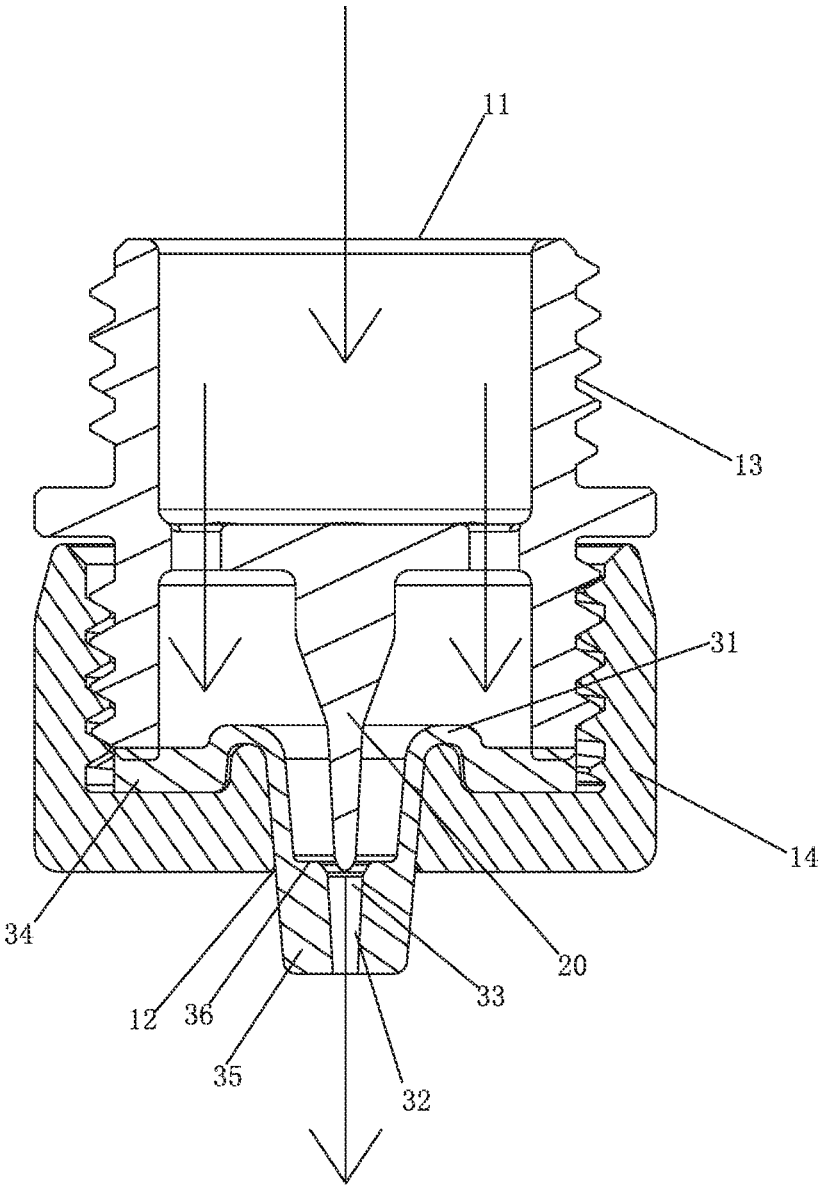
FIG. 4 illustrates a cross-sectional view of the self-cleaning device according to the first embodiment when the deformation portion is in a deformation state and a liquid flow space is formed between the ejector pin and the liquid outlet hole.

Referring to FIG. 4, the deformation portion 31 is in the deformation state. When the deformation portion 31 is deformed from the initial state to the deformation state, the deformation portion 31 moves toward the inner end of the outlet 12 until the deformation portion 31 is completely attached to the inner end of the outlet 12, and the liquid outlet portion 35 also moves along an inner wall of the outlet 12 under the drive of the deformation portion 31. In the first embodiment, a thickness of the deformation portion 31 does not change during the deformation process.

Figure 9:
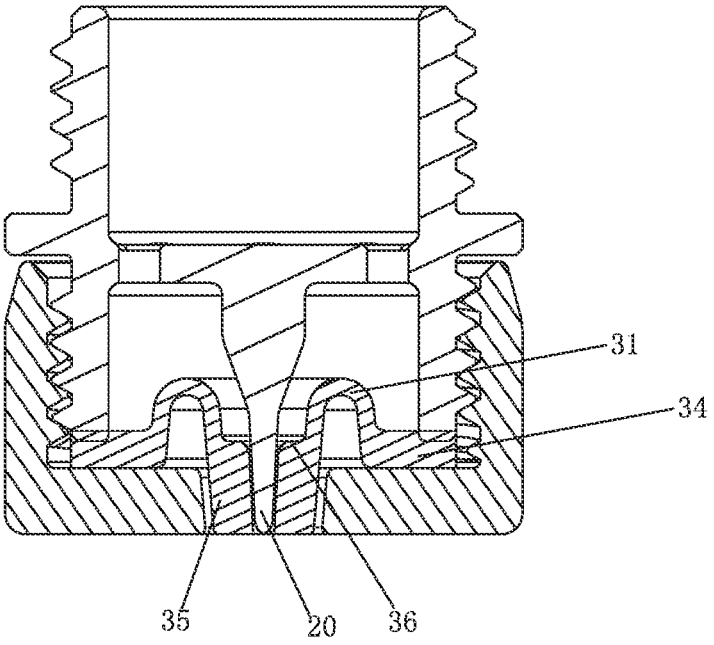
FIG. 9 illustrates a cross-sectional view of the self-cleaning device according to a fifth embodiment, in which an inner end of an outlet has a flat-shape.
Figure 10:
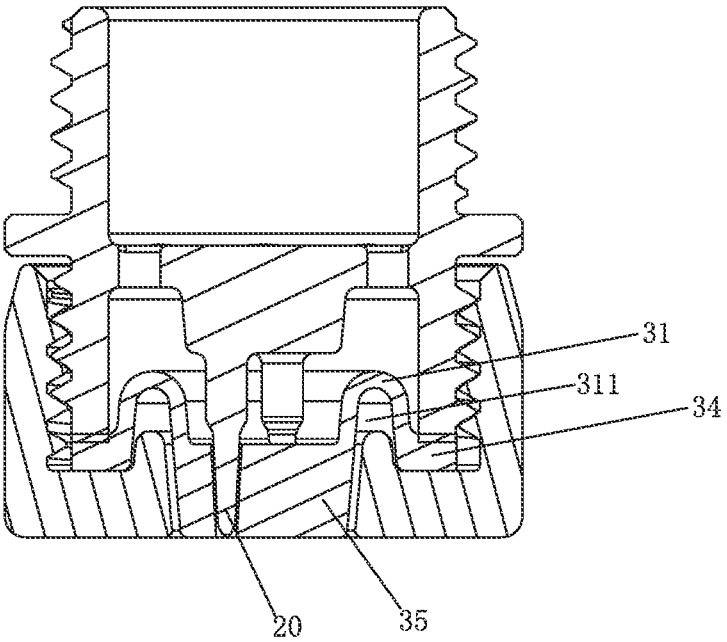
FIG. 10 illustrates a cross-sectional view of the self-cleaning device according to the fifth embodiment, in which the liquid outlet portion comprises three liquid outlet holes.
Figure 11:
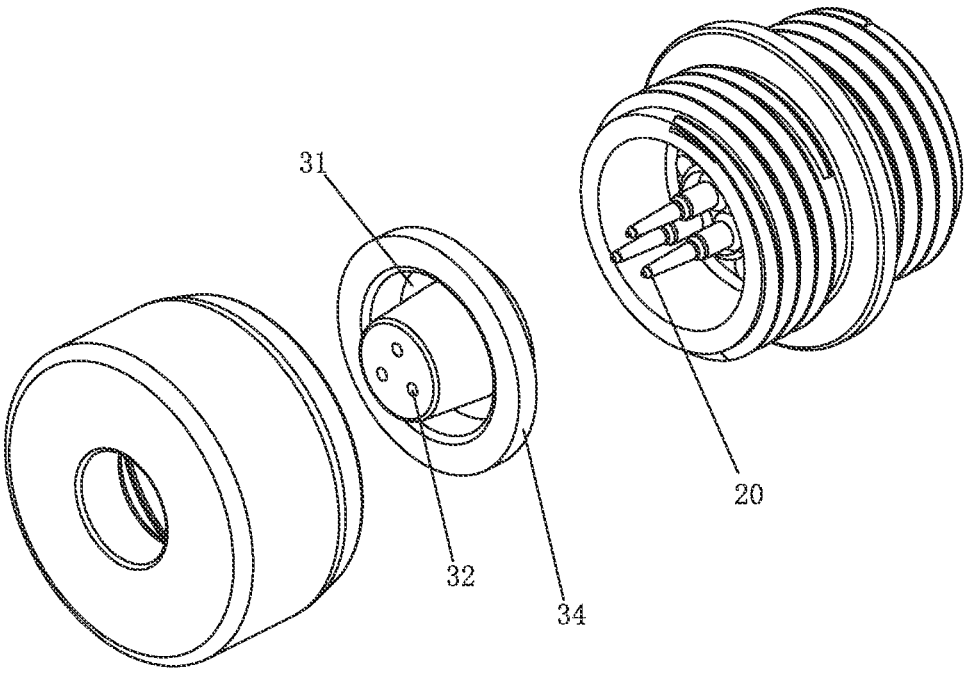
FIG. 11 illustrates an exploded perspective view of the self-cleaning device in FIG. 10.

In the first embodiments, a protrusion 122 protrudes from the inner end of the outlet 12 to increase a depth of the outlet 12, and a shape of the protrusion 122 corresponds to a shape of the deformation portion 31. Referring to FIG. 9-11, a fifth embodiment of a self-cleaning device is provided. The inner end of the outlet 12 has a flat-shape.

In the first embodiments, when the deformation portion 31 is in the initial state, a deformation space 311 formed between the elastic deformation body 30 and the inner end of the outlet 12 is used to provide a space for the deformation of the deformation portion 31.

In the first embodiment, when the deformation portion 31 is in the deformation state, a distal end of the liquid outlet portion 35 protrudes out of an outer end surface of the outlet 12. In some embodiments, the distal end of the liquid outlet portion 35 does not need to protrude out of the outer end surface of the outlet 12, as long as an entire length of the outlet 12 is long enough to receive the deformation portion 31. Referring to FIG. 4, when the deformation portion 31 is in the deformation state, a liquid flow space 33 is formed between the bottom end surface of the one or more ejector pins 20 and an inner wall of the one or more liquid outlet holes 32. Referring to FIG. 3, when the deformation portion 31 is in the initial state, the distal end of the liquid outlet portion 35 is flush with the outer end surface of the outlet 12. At this time, an end part of the one or more ejector pins 20 is entirely located in the one or more liquid outlet holes 32, there is a clearance fit between the one or more ejector pins 20 and the one or more liquid outlet holes 32, and the bottom end surface of the one or more ejector pins 20 is flush with the outer end surface of the one or more liquid outlet holes 32. In some embodiments, when the deformation portion 31 is in the initial state, the distal end of the liquid outlet portion 35 can also be located in the outlet 12, or can extend out of the outer end surface of the outlet 12.

Figure 12:
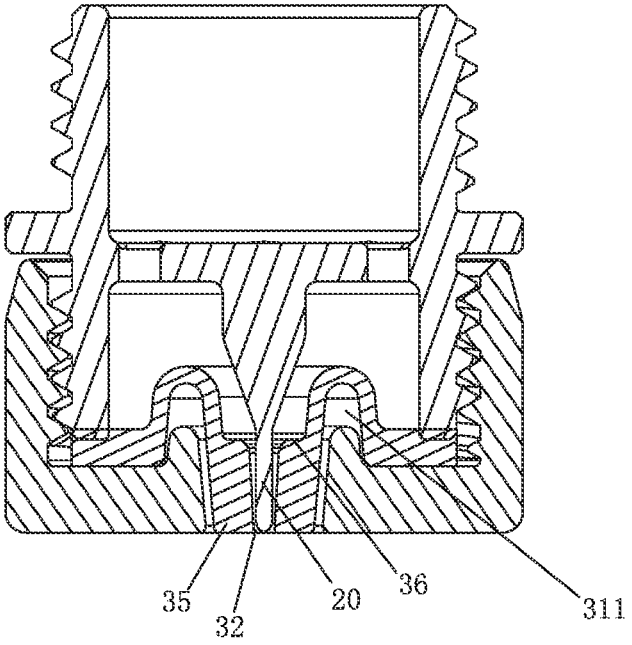
FIG. 12 illustrates a cross-sectional view of the self-cleaning device according to a sixth embodiment, in which a width of the ejector pin is constant and a maximum width of the liquid outlet hole gradually decreases from an inlet to the outlet.
Figure 13:
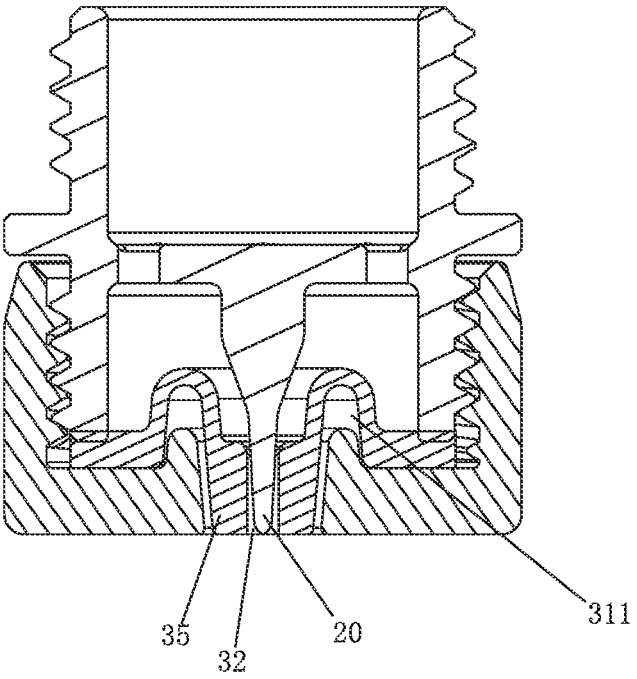
FIG. 13 illustrates a cross-sectional view of the self-cleaning device according to a seventh embodiment, in which a maximum width of the ejector pin gradually decreases from the inlet to the outlet and a width of the liquid outlet hole is constant.
Figure 14:
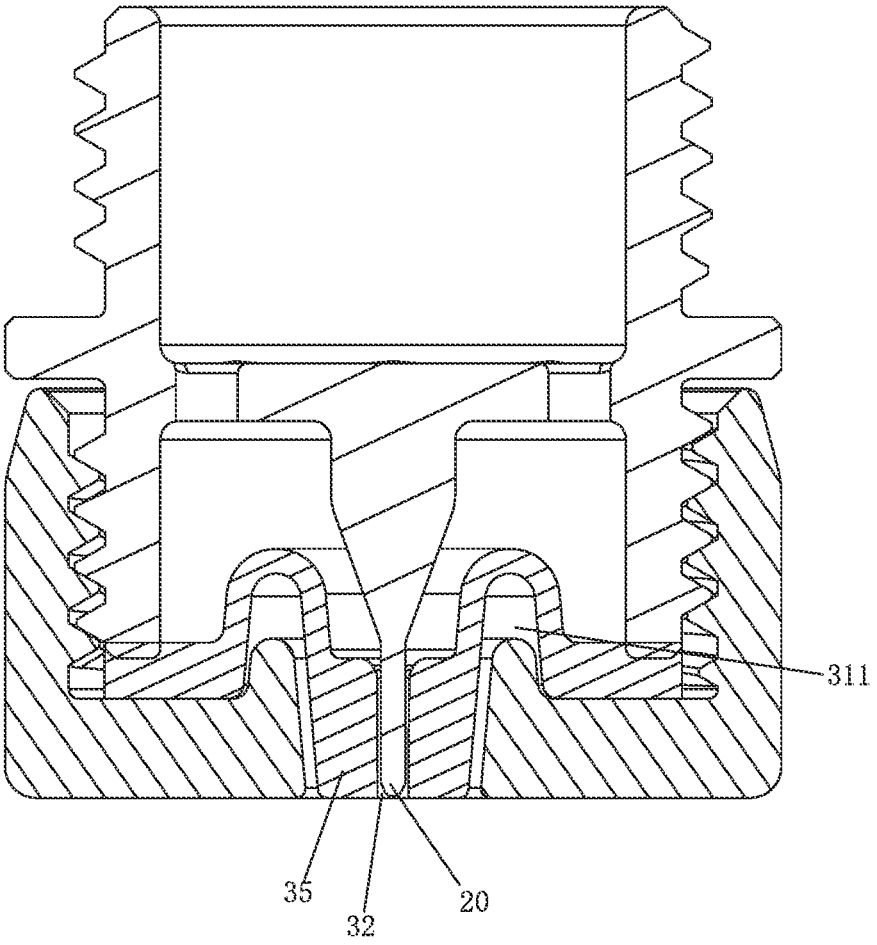
FIG. 14 illustrates a cross-sectional view of the self-cleaning device according to an eighth embodiment, in which the width of the ejector pin is constant and the width of the liquid outlet hole is constant.

In the first embodiment, a maximum width of the one or more ejector pins 20 gradually decreases from the inlet 11 to the outlet 12, and a maximum width of the one or more liquid outlet holes 32 gradually decreases from the inlet 11 to the outlet 12. Referring to FIG. 2, the end part of the one or more ejector pins 20 has a conical shape. Referring to FIG. 4, a lower part of the one or more liquid outlet holes 32 also has a conical shape, which matches the conical shape of the end part of the one or more ejector pins 20. Referring to FIG. 12, a sixth embodiment of a self-cleaning device is provided. A width of the one or more ejector pins 20 is constant, and a maximum width of the one or more liquid outlet holes 32 gradually decreases from the inlet 11 to the outlet 12. Referring to FIG. 13, a seventh embodiment of a self-cleaning device is provided. A maximum width of the one or more ejector pins 20 gradually decreases from the inlet 11 to the outlet 12, and a width of the one or more liquid outlet holes 32 is constant. Referring to FIG. 14, an eighth embodiment of a self-cleaning device is provided. A width of the one or more ejector pins 20 is constant, and a width of the one or more liquid outlet holes 32 is constant.

Figure 5:
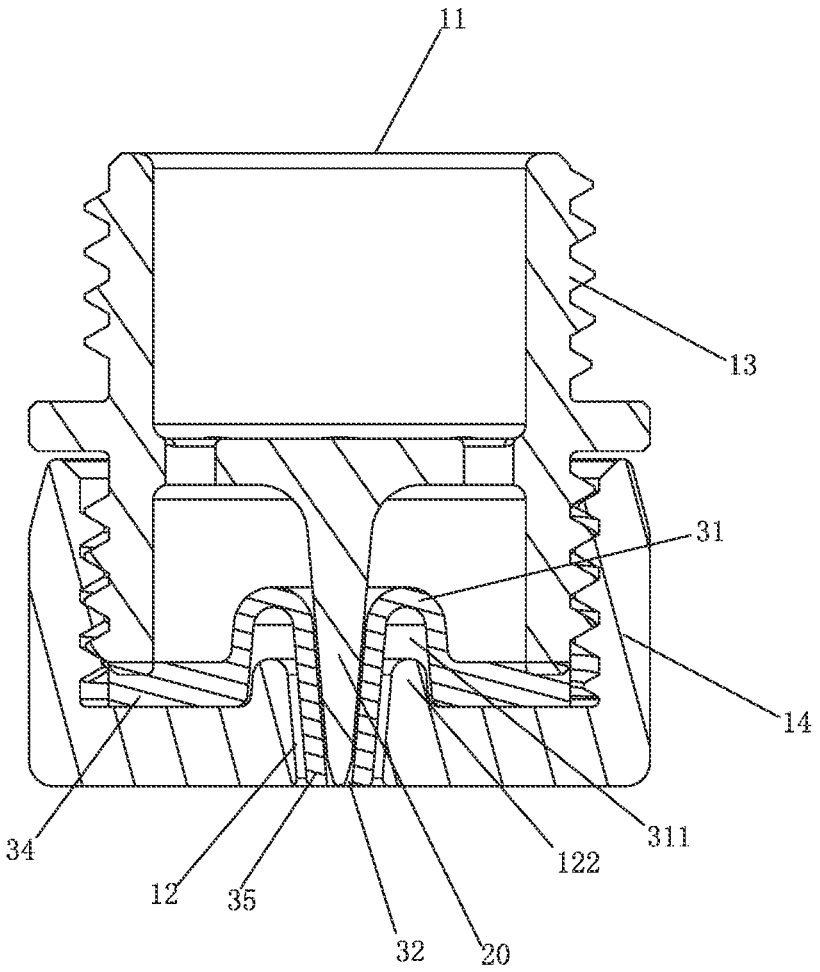
FIG. 5 illustrates a cross-sectional view of the self-cleaning device according to a second embodiment when the deformation portion is in an initial state and the ejector pin is inserted into an entirety of the liquid outlet hole.
Figure 6:
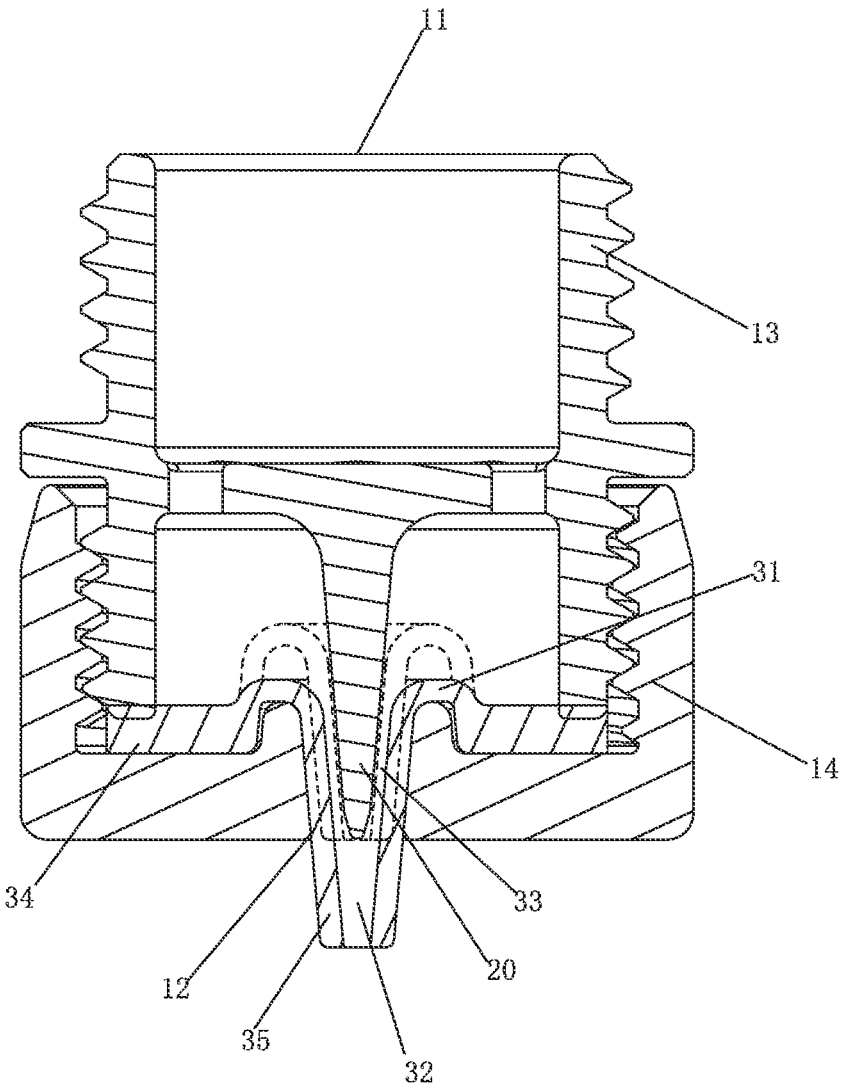
FIG. 6 illustrates a cross-sectional view of the self-cleaning device according to the second embodiment when the deformation portion is in a deformation state and a liquid flow space is formed between the ejector pin and the liquid outlet hole.
Figure 7:
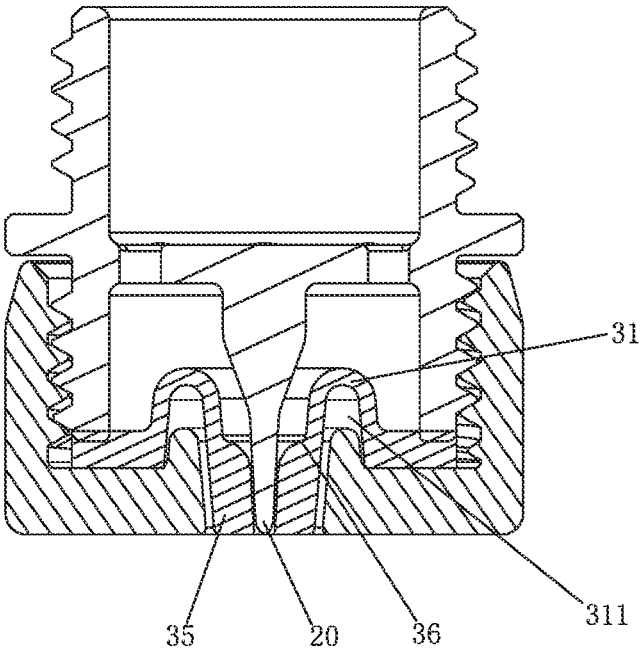
FIG. 7 illustrates a cross-sectional view of the self-cleaning device according to a third embodiment, in which a side edge of a stepped surface close to a center axis of the liquid outlet hole is rounded.
Figure 8:
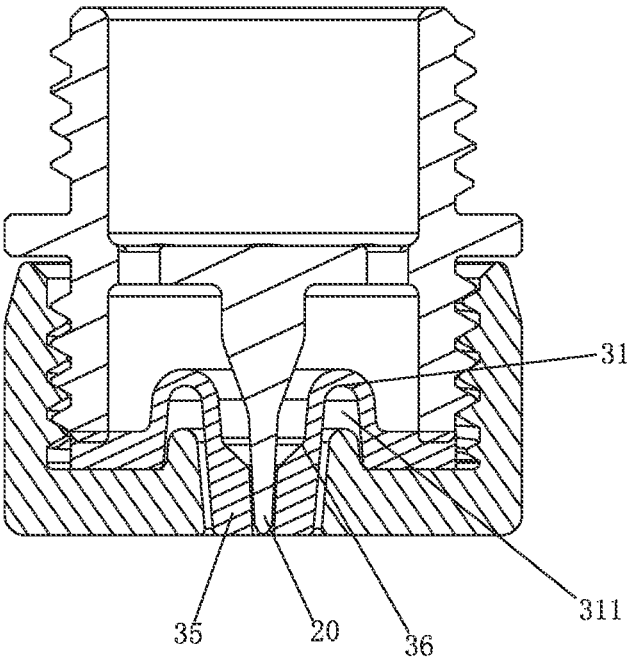
FIG. 8 illustrates a cross-sectional view of the self-cleaning device according to a fourth embodiment, in which the stepped surface is arranged obliquely.

In the first embodiments, the liquid outlet portion 35 comprise a stepped surface 36 for increasing a hydraulic pressure area of the elastic deformation body 30, so that the deformation portion 31 is more quickly affected by the hydraulic pressure and the deformation sensitivity is higher. The stepped surface 36 is perpendicular to a center axis of the one or more liquid outlet holes 32. Referring to FIG. 4, when the deformation portion 31 is in the deformation state, the bottom end surface of the one or more ejector pins 20 is flush with the stepped surface 36. Referring to FIGS. 5-6, a second embodiment of a self-cleaning device is provided. The self-cleaning device dose not comprises a stepped surface 36, and the self-cleaning device can still achieve a cleaning effect. Referring to FIG. 7, a third embodiment of a self-cleaning device is provided. A side edge of a stepped surface 36 close to the center axis of the one or more liquid outlet holes 32 is rounded. Referring to FIG. 8, a fourth embodiment of a self-cleaning device is provided. A stepped surface 36 is arranged obliquely, and an included angle between the center axis of the one or more liquid outlet holes 32 and the stepped surface 36 is an acute angle.

Referring to FIG. 2, in the elastic deformation body 30, the fixed portion 34, the deformation portion 31, and the liquid outlet portion 35 are in a one-to-one correspondence, and the liquid outlet portion 35 comprises only one liquid outlet hole 32. Referring to FIGS. 10-11, in the fifth embodiments, the liquid outlet portion 35 comprises three liquid outlet holes 32. In some embodiments, the liquid outlet portion 35 can also comprises two, four, five, or more liquid outlet holes 32, and one elastic deformation body 30 can also comprises a plurality of deformation portions 31 and a plurality of liquid outlet portions 35.

The self-cleaning device realizes the function of conducting liquid or cleaning the one or more liquid outlet holes 32 through the cooperation of the elastic deformation body 30 and the hydraulic pressure. When the liquid stops flowing in the liquid flow chamber 10, the one or more ejector pins 20 are inserted into the one or more liquid outlet holes 32 to remove the scale in the one or more liquid outlet holes 32 to achieve the purpose of descaling and cleaning. When the liquid flows in the liquid flow chamber 10, the deformation portion 31 is deformed due to the hydraulic pressure to space apart the one or more ejector pins 20 and the one or more liquid outlet holes 32 to form a liquid flow space 33. At this time, the liquid can flow out of the liquid flow chamber 10 through the liquid flow space 33. The self-cleaning device is not only simple in structure, but also requires a small space for the deformation process of the deformation portion 31 of the elastic deformation body 30. Therefore, it is only necessary to reserve a small space in common water outlet devices, such as shower heads or sprayers, and the size of the water outlet device does not change greatly. The self-cleaning device has a good cleaning and descaling effect. The one or more ejector pins 20 can be inserted into the one or more liquid outlet holes 32, and the one or more liquid outlet holes 32 are cleaned. The elastic deformation body 30 has a long service life, is suitable for long-term repeated use, and avoids the trouble of frequent replacement.

Figure 15:
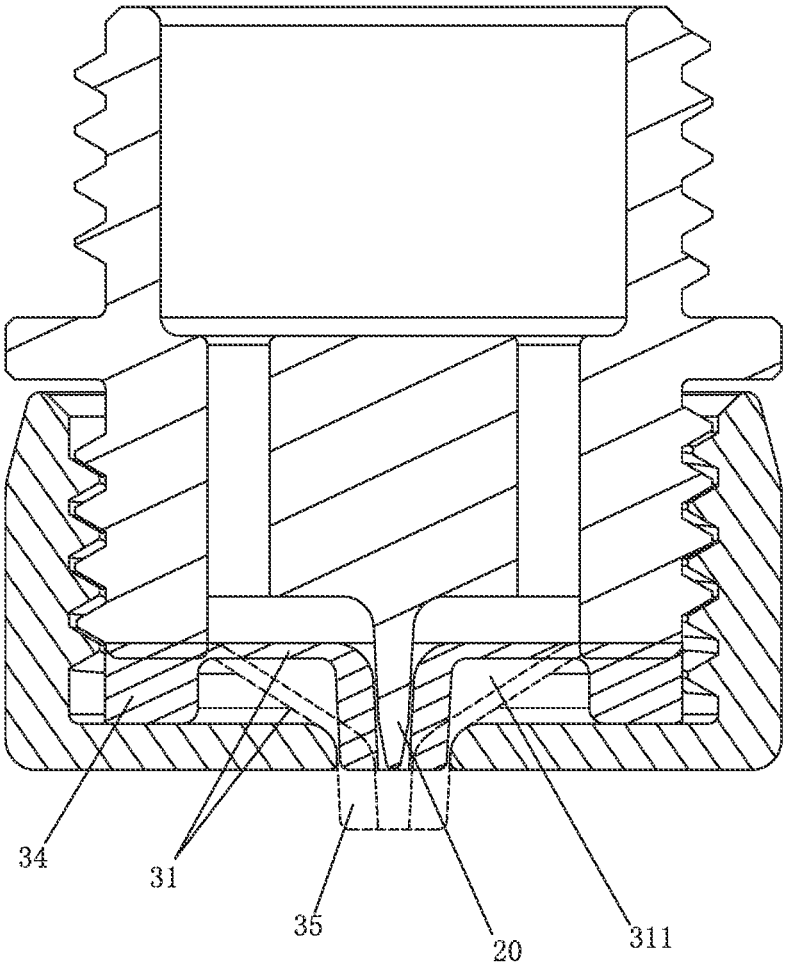
FIG. 15 illustrates a cross-sectional view of the self-cleaning device according to a ninth embodiment, in which the deformation portion has a sheet-shape.

Referring to FIG. 15, a ninth embodiment of the self-cleaning device is provided. The differences between the ninth embodiment and the first embodiment will be further described below.

In the ninth embodiment, the deformation portion 31 has a sheet-shape. When the liquid flows in the liquid flow chamber 10, the deformation portion 31 is stretched and deformed to enable a thickness of the deformation portion 31 to stretch due to the hydraulic pressure to form the liquid flow space 33 between the one or more ejector pins 20 and the one or more liquid outlet holes 32. When there is no hydraulic pressure in the liquid flow chamber 10, the deformation portion 31 is reset to the initial state, and the one or more ejector pins 20 are inserted into the one or more liquid outlet holes 32 to clean the one or more liquid outlet holes 32.

In the ninth embodiment, when the deformation portion 31 is in the initial state, a top end surface of the deformation portion 31 is flush with a top end surface of the liquid outlet portion 35, and the top end surface of the deformation portion 31 is arranged perpendicular to a center axis of the liquid outlet portion 35. At this time, no accumulation of water in the liquid flow chamber 10 can be ensured, and the thickness of the liquid flow chamber 10 can be designed to be thinner. As shown in FIG. 15, when the deformation portion 31 is deformed, the deformation portion 31 is stretched obliquely to enable the thickness of the deformation portion 31 to become thinner. When the deformation portion 31 is in the deformation state, the deformation portion 31 can also be attached to the inner end of the outlet 12. According to design needs, when the deformation portion 31 is in the initial state, the top end surface of the deformation portion 31 and the center axis of the liquid outlet portion 35 have an acute angle.

In the ninth embodiments, an elongation rate of the deformation portion 31 is 1% to 20%. Preferably, the elongation rate of the deformation portion 31 is 3% to 6% to ensure the best deformation effect.

Figure 16:
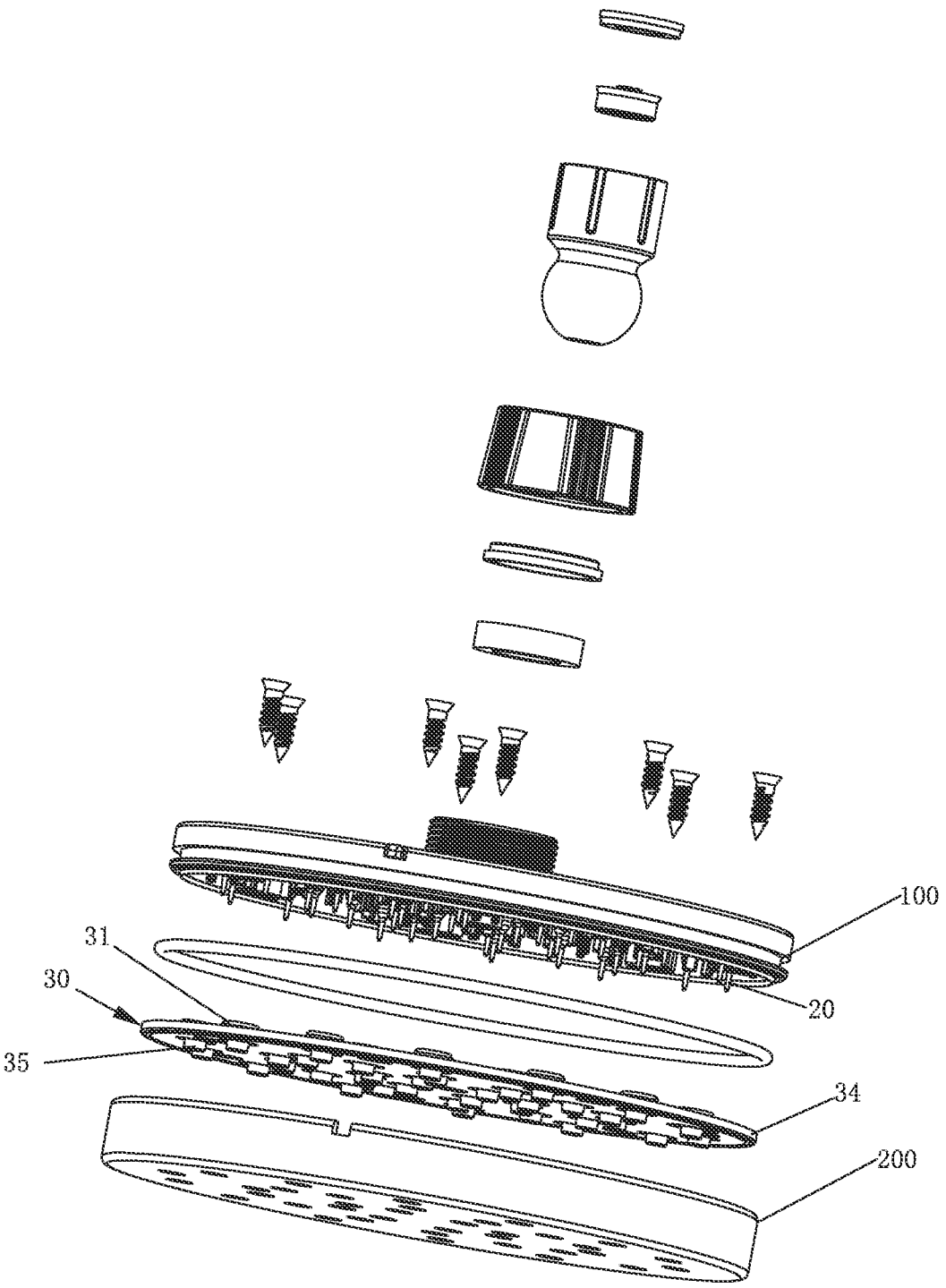
FIG. 16 illustrates an exploded perspective view of a shower head.
Figure 17:
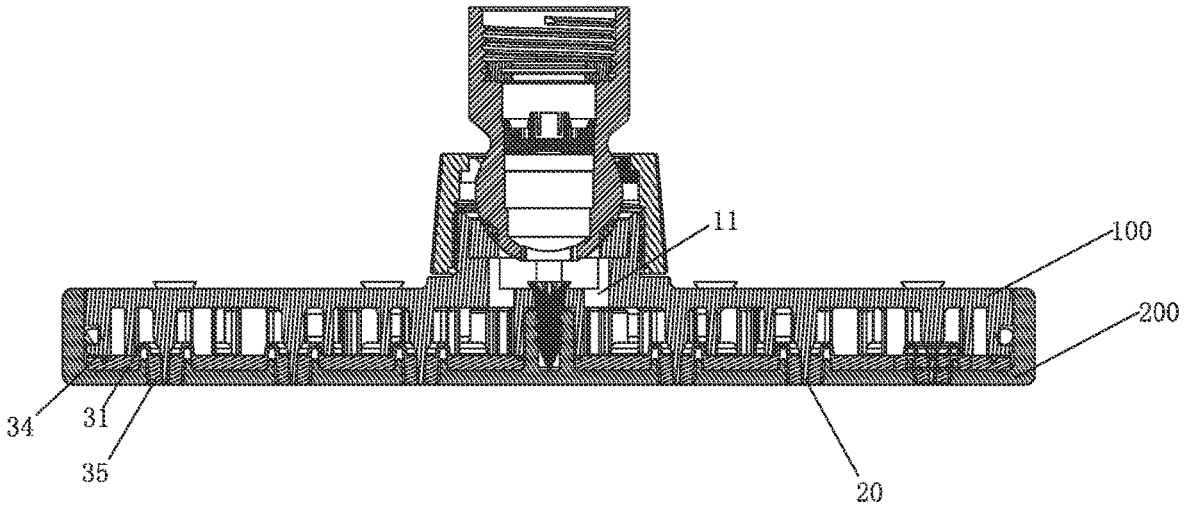
FIG. 17 illustrates a cross-sectional view of the shower head, in which the deformation portion is in an initial state.
Figure 18:
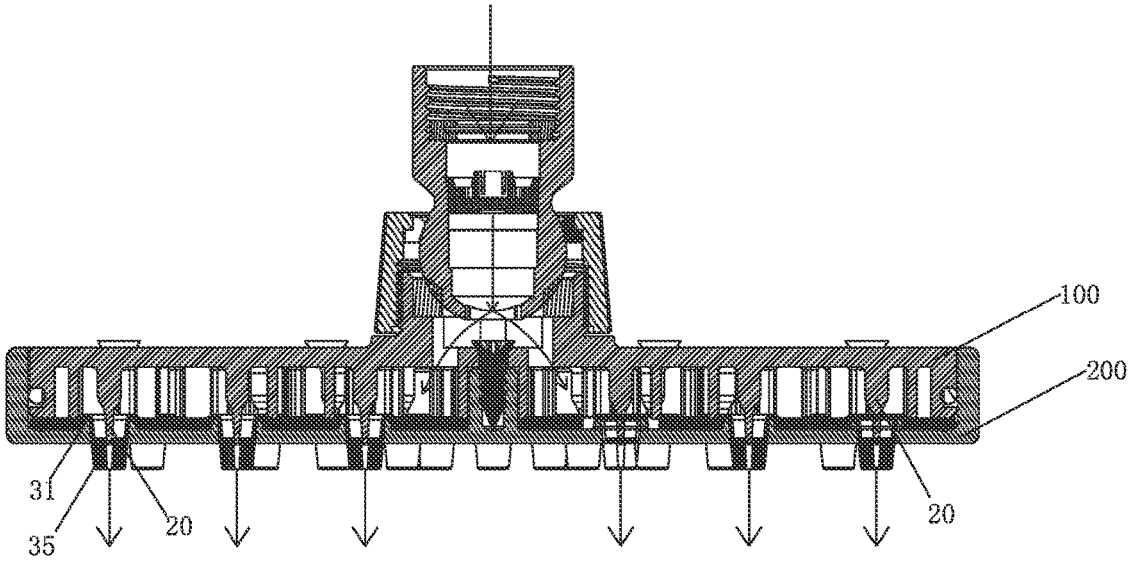
FIG. 18 illustrates a cross-sectional view of the shower head, in which the deformation portion is in a deformation state.

Referring to FIGS. 16-18, a shower head comprising the above-mentioned self-cleaning device is provided.

The shower head comprises a shower head body 100 and shower cover assembly 200. The shower head body 100 comprises the outlet 12. The one or more ejector pins 20 are fixed in shower head body 100, and the elastic deformation body 30 is disposed between the shower head body 100 and shower cover assembly 200.

The self-cleaning device can also be applied to sprayers, faucets, shower bars, and pull-out faucets in kitchens and can also be applied to non-bathroom showers and in any other places where a liquid discharge device is needed.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A self-cleaning device, comprising:
a liquid flow chamber,
one or more ejector pins, and
an elastic deformation body, wherein:
the liquid flow chamber comprises an inlet and an outlet,
the one or more ejector pins are arranged between the inlet and the outlet,
the elastic deformation body is disposed on the outlet,
the elastic deformation body comprises a deformation portion and a liquid outlet portion,
the deformation portion surrounds the liquid outlet portion,
the liquid outlet portion comprises one or more liquid outlet holes,
the one or more ejector pins extend toward the one or more liquid outlet holes,
a protrusion protrudes from an inner end of the outlet,
a shape of the protrusion corresponds to a shape of the deformation portion,
when a liquid flows in the liquid flow chamber, the deformation portion is deformed due to hydraulic pressure to form a liquid flow space between the one or more ejector pins and the one or more liquid outlet holes, and
when there is no hydraulic pressure in the liquid flow chamber, the deformation portion is reset to an initial state, and the one or more ejector pins are inserted into the one or more liquid outlet holes to clean the one or more liquid outlet holes.

2. The self-cleaning device according to claim 1, wherein:
when the deformation portion is in the initial state:
a bottom end surface of the one or more ejector pins is flush with an outer end surface of the one or more liquid outlet holes, and there is a clearance fit between the one or more ejector pins and the one or more liquid outlet holes, or
the bottom end surface of the one or more ejector pins protrudes outside the outer end surface of the one or more liquid outlet holes, and there is a clearance fit between the one or more ejector pins and the one or more liquid outlet holes.

3. The self-cleaning device according to claim 1, wherein:
when the deformation portion is in the initial state, a bottom end surface of the one or more ejector pins moves into the one or more liquid outlet holes by at least half of a depth of the one or more liquid outlet holes, and there is a clearance fit between the one or more ejector pins and the one or more liquid outlet holes.

4. The self-cleaning device according to claim 1, wherein:
a first body is connected to a second body to form the liquid flow chamber,
the elastic deformation body further comprises a fixed portion,
the deformation portion connects the fixed portion and the liquid outlet portion,
the fixed portion is clamped between the first body and the second body to be fixed on an inner wall of the liquid flow chamber,
the liquid outlet portion is moveable into the outlet from the inner end of the outlet,
and
when the deformation portion is deformed, the deformation portion moves between the initial state and a deformation state at which the deformation portion abuts the inner end of the outlet.

5. The self-cleaning device according to claim 1, wherein:
a maximum width of the one or more ejector pins gradually decreases from the inlet to the outlet, and
a maximum width of the one or more liquid outlet holes gradually decreases from the inlet to the outlet.

6. The self-cleaning device according to claim 1, wherein:
a width of the one or more ejector pins is constant, and
a maximum width of the one or more liquid outlet holes gradually decreases from the inlet to the outlet.

7. The self-cleaning device according to claim 1, wherein:
a maximum width of the one or more ejector pins gradually decreases from the inlet to the outlet, and
a width of the one or more liquid outlet holes is constant.

8. The self-cleaning device according to claim 1, wherein:

a width of the one or more ejector pins is constant, and a width of the one or more liquid outlet holes is constant.

9. The self-cleaning device according to claim 1, wherein:

a wall of the liquid outlet portion comprises a stepped surface for increasing a hydraulic pressure area of the elastic deformation body.

10. The self-cleaning device according to claim 9, wherein:

the stepped surface is perpendicular to a center axis of the one or more liquid outlet holes.

11. The self-cleaning device according to claim 9, wherein:

the stepped surface is arranged obliquely with a center axis of the one or more liquid outlet holes to form an acute angle.

12. The self-cleaning device according to claim 1, wherein:

the one or more ejector pins is a plurality of ejector pins, the one or more liquid outlet holes is a plurality of liquid outlet holes, and the plurality of ejector pins and the plurality of liquid outlet holes are in a one-to-one correspondence.

13. The self-cleaning device according to claim 1, wherein:

a deformation space disposed between the elastic deformation body and the inner end of the outlet is provided for deformation of the deformation portion.

14. A water outlet device comprising the self-cleaning device of claim 1.

* * * * *